United States Patent [19]

Sudo

[11] Patent Number: 4,621,986

[45] Date of Patent: Nov. 11, 1986

[54] ROTARY-VANE COMPRESSOR

[75] Inventor: Yukio Sudo, Atsugi, Japan

[73] Assignee: Atsugi Motor Parts Company, Limited, Japan

[21] Appl. No.: 804,399

[22] Filed: Dec. 4, 1985

[51] Int. Cl.[4] ..... F04B 49/02

[52] U.S. Cl. ..... 417/304; 417/310

[58] Field of Search ..... 417/310, 302, 304, 292

[56] References Cited

U.S. PATENT DOCUMENTS

| | | | |
|---|---|---|---|
| 2,755,741 | 7/1956 | Erskine | 417/304 X |
| 4,452,571 | 6/1984 | Koda et al. | 417/310 X |
| 4,544,333 | 10/1985 | Hirano | 417/310 X |

*Primary Examiner*—Richard E. Gluck

*Attorney, Agent, or Firm*—Lane and Aitken

[57] ABSTRACT

A rotary-vane compressor wherein the pump housing is formed with a first by-pass passage which is open at its one end to the first intake port of the two intake ports which are open to the pump chamber formed in the rotor and at its other end with the high-pressure chamber formed in the main housing, and provided with first by-pass valve means so that the first by-pass passage is opened when an external signal is supplied, and the first ring plate mounted on one side of the cam ring is provided with an one-way flow check valve to block fluid communication between the first intake port and the low-pressure chamber to which a new refrigerant is conducted, only when the first by-pass passage is opened.

6 Claims, 5 Drawing Figures

ROTARY-VANE COMPRESSOR

FIELD OF THE INVENTION

The present invention relates in general to a rotary-vane compressor which is adapted for use in an air conditioning apparatus of an automotive vehicle or like apparatus, and in particular to an improved rotary-vane compressor in which the discharge volume of working medium such as refrigerant is controlled depending upon the change of atmospheric pressure, humidity and the like.

SUMMARY OF THE INVENTION

In accordance with an important aspect of the present invention, there is provided a rotary-vane compressor comprising: a main housing formed with a high-pressure chamber; a front-housing plate secured to the main housing and formed with a low-pressure chamber; and compression means arranged within the main housing; the compression means comprising a pump housing comprising a cam ring formed with a substantially eliptical cam surface and first and second ring plates mounted on the cam ring to close the cam ring, a rotor rotatably supported within the cam ring and formed a plurality of substantially radially extending slots and a plurality of back-pressure passages each held in fluid communication with an radially inward end of the corresponding slot, and a plurality of vanes each received slidably in the corresponding slot, lubricating oil in the high-pressure chamber being conducted to the back-pressure passages; the cam surface of the cam ring and an outer peripheral surface of the rotor forming a pump chamber; the cam ring being formed with first and second intake ports which respectively communicate at their one ends with the low-pressure chamber and at their the other ends with the pump chamber and a pair of discharge ports which respectively communicate at their one ends with the pump chamber and at their the other ends the high-pressure chamber, wherein the pump housing is formed with a first by-pass passage which is open at its one end to the first intake port and at its the other end with the high-pressure chamber, and provided with first by-pass valve means so that the first by-pass passage is opened when an external signal is supplied, and the first ring plate is provided with an one-way flow check valve to block fluid communication between the first intake port and the low-pressure chamber only when the first by-pass passage is opened.

DESCRIPTION OF THE PRIOR ART

A rotary-vane compressor of the variable discharge volume type is conventionally constructed to comprise a generally eliptical-shaped cam ring closed at its opposite sides by a pair of side plates, and a rotor rotatably supported in the cam ring. The rotor is formed with a plurality of radially extending slots in which a plurality of vanes are slidably received so that each vane is projectable from and retractable in the corresponding slot. A plurality of pump chambers are defined by adjacent vanes between the cam ring and rotor. To each pump chamber is conducted working medium such as freon gas through a pair of first and second intake ports. The freon gas is compressed by the vanes when the rotor rotates along the cam surface of the cam ring, and then discharged through a pair of discharge ports.

The first and second intake ports are formed in the cam ring and circumferentially equiangularly spaced apart 180 degrees from each other with respect to the axis of rotation of the cam ring. The intake ports are each in fluid communication with a single inlet port formed in a housing of the rotary-vane compressor. Each discharge port is formed in the cam ring and circumferentially equiangularly spaced apart a predetermined distance from the intake port. One of the intake ports, for example, the first intake port, is provided with valve means such as an electrically operated valve to block fluid communication between the first intake port and the pump chamber. If the discharge volume of the compressor exceeds a required quantity during travelling of the vehicle at high speed, the fluid communication between the first intake port and the pump chamber is blocked by turning repeatedly on and off the electrically operated valve provided in the first intake port so that the discharge volume is controlled.

It has, however, been found that such conventional rotary-vane compressor has some drawbacks. For example, since vanes rotates on and along the cam surface of the cam ring across the pump chamber in which the supply of the refrigerant is cut off by closing the first intake port with the electrically operated valve, the pump chamber is gradually made substantially vacuous so that an extremely low pressure is created, and an adverse force acts on the vanes in the direction opposite to the direction of rotation of the rotor. For these reasons, power lost of the compressor itself is increased, and refrigerant compressed to high pressure and temperature leaks in the pump chamber in which the extremely low pressure is created. Furthermore, since a new refrigerant is not supplied to the pump chamber and accordingly the temperature of the pump chamber is not decreased at all due to the new refrigerant, there is another problem that the pump chamber is heated to an abnormally high temperature. Since compression pressure is not created in the abovementioned pump chamber in which the new refrigerant is not supplied and accordingly the pressure balance of the compressor itself is not maintained, the vanes are urged against the cam surface of the cam ring across the pump chamber. As a consequence, wear on the cam ring and the vanes are increased and the life of the compressor itself is decreased. Accordingly, the object of the present invention is to provide an improved rotary-vane compressor which can eliminate the above-noted drawbacks inevitably inherent in the conventional rotary-vane compressor.

BRIEF DESCRIPTION OF THE FIGURES OF THE DRAWINGS

The features and advantages of the rotary-vane compressor constructed in accordance with the present invention will be more fully understood from a consideration of the following detailed description in conjunction with the accompanying drawings in which.

DETAILED DESCRIPTION OF THE PREFERRED EMBODIMENT

Figure 1:
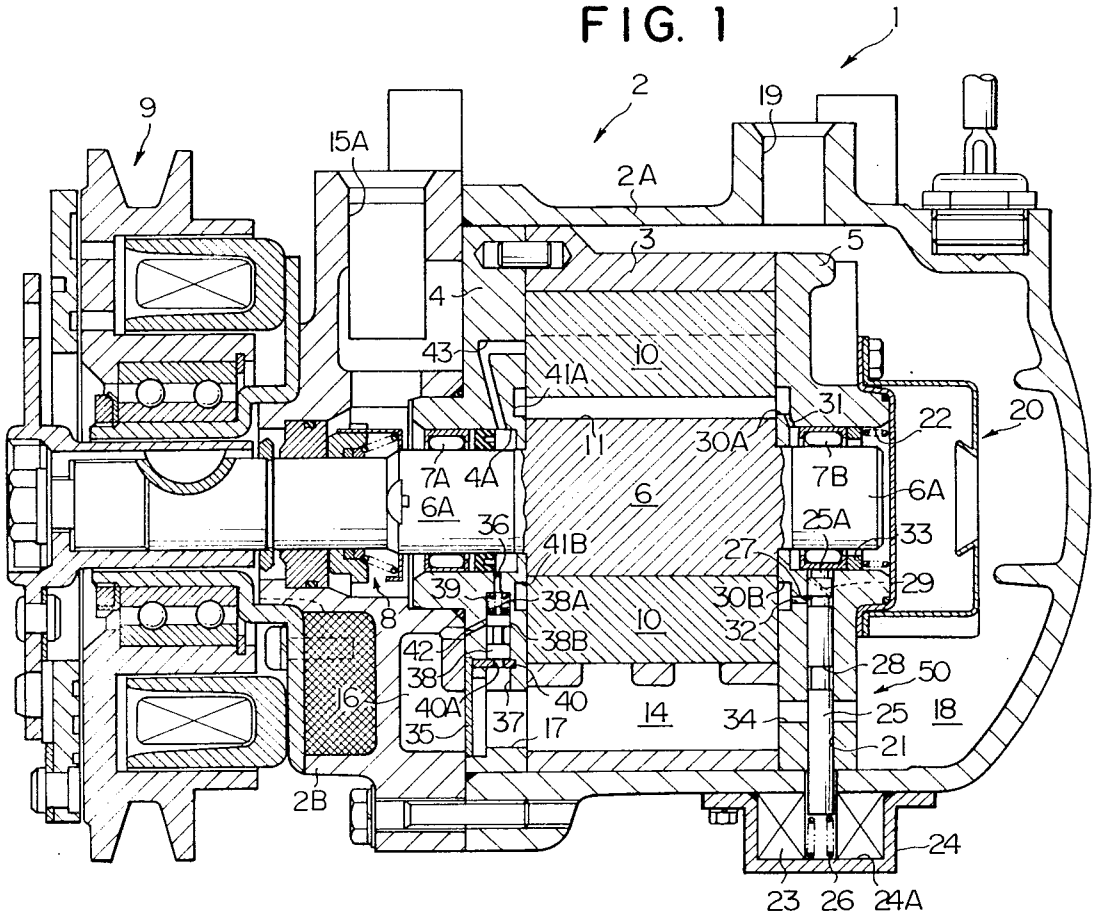
FIG. 1 is a longitudinal sectional view showing the rotary-vane compressor constructed in accordance with the present invention.

Referring now in greater detail to the drawings and initially to FIG. 1, a rotary-vane compressor constructed in accordance with the present invention is indicated generally by reference character 1. The rotary-vane compressor 1 comprises a compressor casing 2 having two main parts 2A and 2B. The part 2A will be hereinafter designated as a main housing, and the part 2B will be hereinafter designated as a front-housing plate. The main housing 2A is in the form of a cylinder and the front annular wall of the main housing 2A is formed for engagement with the complemental rear wall of the front-housing plate 2B. The main housing 2A and front-housing plate 2A are held in axially fast, assembled relationship by suitable clamping means such as clamping bolts. In the main housing 2A is mounted compression means which is constructed to comprise a cam ring 3 formed at the inner wall thereof with a substantially eliptical cam surface, front-ring or first ring and rear-ring or second ring plates 4 and 5 mounted on the opposite front and rear walls of the cam ring 3 and closing the cam ring 3, and a rotor 6 of circular configuration which is situated within the cam ring 3 and between the front-ring and rear-ring plates 4 and 5. The rotor 6 is formed with a central opening in which a rotor-drive shaft 6A is closely fitted so that the rotor 6 is rotatable with the rotor-drive shaft 6A. The rotor-drive shaft 6A is supported for rotation by means of a front needle bearing 7A received in a bearing bore 4A formed in the front-ring plate 4 and a rear needle bearing 7B received in a bearing bore 22 formed in the rear-ring plate 5. The front end of the rotor-drive shaft 6A projects from the front-housing plate 2B through a mechanical seal 8 received on a central opening formed in the front-housing plate 2B, and has an electrically operated clutch 9 mounted thereon. The rotor-drive shaft 6A may be connected through the electrically operated clutch 9 with the crank shaft of an internal combustion engine (not shown).

Figure 2:
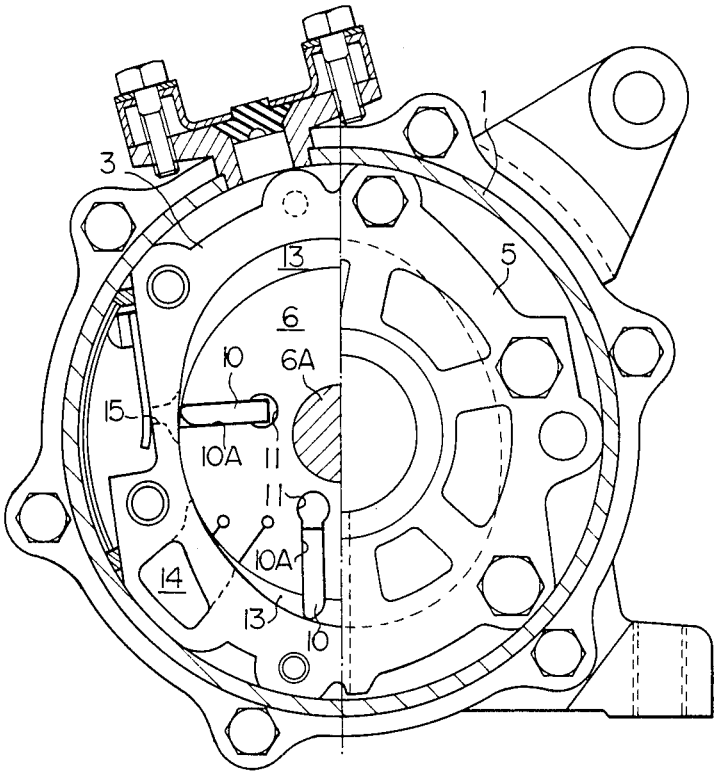
FIG. 2 is a cross sectional view showing the rotary-vane compressor shown in FIG. 1, a rear-ring plate of a cam ring having partly been removed to show components within the cam ring.

The rotor 6 is, as shown in FIG. 2, formed with a plurality of circumferentially equiangularly spaced, radially extending slots 10A. In these slots 10A are slidably received a plurality of vanes 10 corresponding in number to the slots 10A such that each vane 10 is projectable radially outwardly from and retractable radially inwardly in the corresponding slot 10A. Each slot 10A is formed at the radially innermost end or base portion thereof with a back-pressure passage 11 extending in the axial direction which is substantially parallel to the axis of rotation of the rotor-drive shaft 6A. To each back-pressure passage 11 is conducted lubricating oil reservoired in the bottom portion of the main housing 2A through a first oil passage 12 (FIG. 4) which is formed in the rear-ring plate 5 and extends in the radial direction which is substantially perpendicular to the axis of rotation of the rotor-drive shaft 6A. When the rotor 6 is in operation, the vanes 10 are urged radially outwardly against the cam surface of the cam ring 3 due to the centrifugal force acting on the vanes 10 and hydraulic pressure existing in back of the vanes 10, so that the vanes 10 are projected radially outwardly from and retracted radially inwardly in the slots 10A along the cam surface of the cam ring 3 during rotation of the rotor 6. As a result of the movement of the vanes 10, a plurality of chambers are defined by adjacent vanes 10 in a pump chamber 13 defined between the cam surface of the cam ring 3 and the outer peripheral surface of the rotor 6. As the vanes 10 rotate along and on the cam surface of the cam ring 3, each chamber of the pump chamber 13 is expanded and contracted in volume because the contour of the cam surface of the cam ring 3 deviates from the contour of the outer peripheral surface of the rotor 6. Thus, each chamber of the pump chamber 13 serves as an intake chamber when expanded in volume and as a compression chamber when contracted in volume.

The cam ring 3 is formed with axially extending first and second intake ports 14 which are spaced apart 180 degrees with respect to the axis of rotation of the rotor-drive shaft 6A and open at their one ends to the pump chamber 13. The cam ring 3 is further formed with a pair of axially extending discharge ports 15 which are spaced predetermined distances from the intake ports 14, respectively, and open at their one ends to the pump chamber 13. Each intake port 14 serves to conduct working medium such, for example, as refrigerant to the pump chamber 13. More particularly, the refrigerant is admitted to the pump chamber 13 through the intermediary of an inlet port 15A formed in the front-housing plate 2B, a low-pressure chamber 16 formed in the front-housing plate 2B and communicated with the inlet port 15A, and a pair of first and second inlet passages 17 formed in the front-ring plate 4 and open at the front ends thereof to the low-pressure chamber 16 and at the rear ends thereof to the corresponding first and second intake ports 14.

Each discharge port 15 formed in the cam ring 3 and open at its one end to the pump chamber 13 is open at its the other end to a high-pressure chamber 18 formed in the main housing 2A. The discharge ports 15 are each adapted to discharge the refrigerant under high pressure from the pump chamber 13 to the high-pressure chamber 18. The refrigerant admitted to the high-pressure chamber 18 is discharged through an outlet port 19 formed in the upper portion of the main housing 2A. An oil separator designated generally by reference character 20 is mounted on the rear-ring plate 5 by means of clamping bolts and serves to separate lubricating oil from the refrigerant and then reservoir in the bottom portion of the high-pressure chamber 18.

Figure 4:
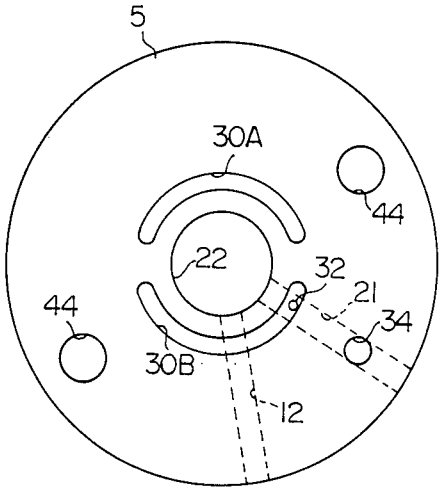
FIG. 4 is a front end view of a rear-ring plate shown in FIGS. 1 and 2, the rear-ring plate being mounted on the rear end of the cam ring.
Figure 5:
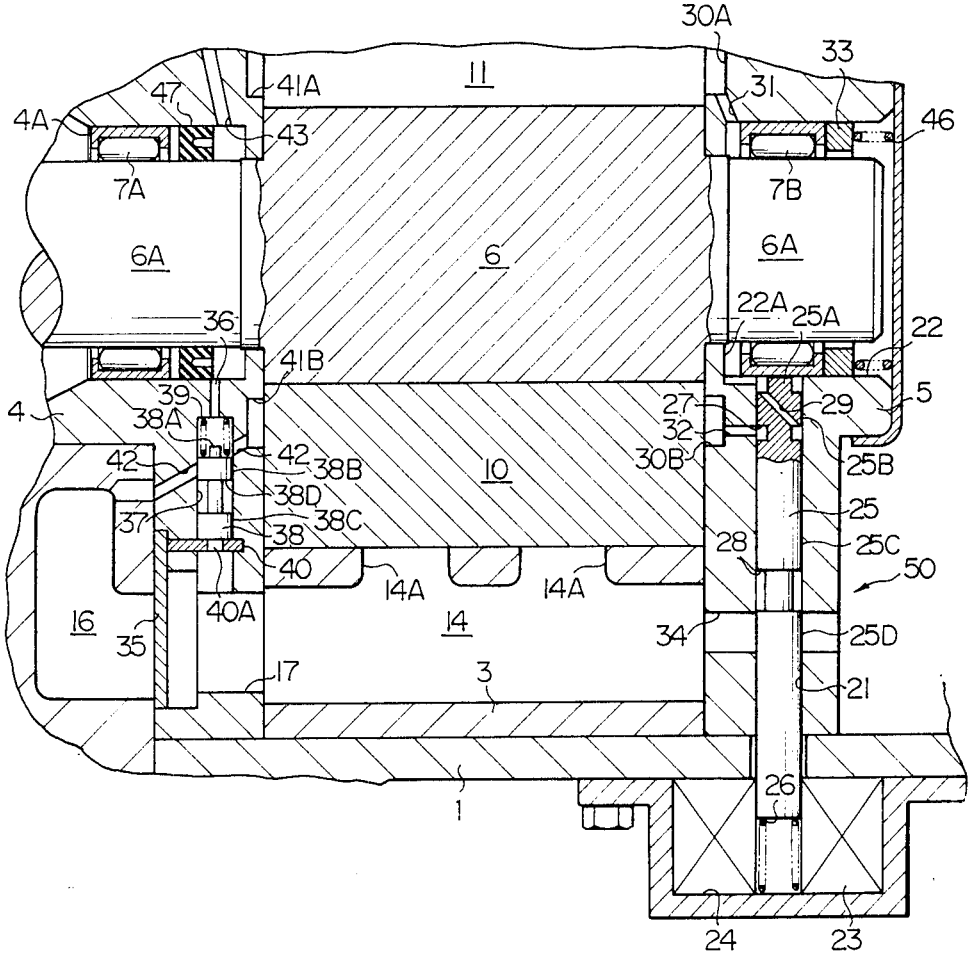
FIG. 5 is a part-enlarged section view of the rotary-vane compressor shown in FIG. 1.

In the rear-ring plate 5 is, as shown in FIGS. 1, 4 and 5, formed a first by-pass passage 34 to establish fluid communication between one of the intake ports 14, for example, the first intake port 14, and the high-pressure chamber 18. The first by-pass passage 34 is open at its one end to the first intake port 14 and at its the other end to the high-pressure chamber 18. The rear-ring plate 5 is further formed with a radially extending valve bore 21 which intersects perpendicularly the first by-pass passage 34 and is spaced apart a predetermined angular distance from the first oil passage 12 which is adapted to conduct the lubricating oil reservoired in the bottom portion of the main housing 2A to each back-pressure passage 11. The valve bore 21 is open at the radially inward end thereof to the bearing bore 22 formed in the rear-ring plate 5 and at the radially outward end thereof through an opening formed in the bottom wall of the main housing 2A to a retainer bore 24A formed in a coil retainer 24 which is secured to the bottom wall of the main housing 2A by clamping bolts. The coil retainer 24 has housed therein an electrically operated coil 23 which is energized by a suitable actuator (not shown). In the valve bore 21 is slidably received first valve means such, for example, as a first by-pass spool valve 25 formed with a projection 25A, an upper land 25B, an intermediate land 25C, a lower land 25D, an upper circumferential groove 27 between the upper land 25B and the intermediate land 25C, and a lower circumferential groove 28 between the intermediate land 25C and the lower land 25D, as shown in FIG. 5. The upper circumferential groove 27 is sized to be substantially equal to a passage 32 to be described later, while the lower circumferential groove 28 is sized to be substantially equal to the first by-pass passage 34 arranged between the first intake port 14 and the high-pressure chamber 18. In the upper land 25B of the by-pass spool valve 25 is formed an oblique passage 29 one end of which is held in fluid communication with the bearing bore 22 of the rear-ring plate 5 through a groove 22A formed in the rear-ring plate 5 and the other end of which is held in fluid communication with the upper circumferential groove 27 of the by-pass spool valve 25. This arrangement allows the lubricating oil conducted to the bearing bore 22 to flow in the the upper circumferential groove 27 of the by-pass spool valve 25. A suitable spring means such as a helical compression spring 26 is seated between the radially outward end of the by-pass spool valve 25 and the inner wall of the coil retainer 24 for urging radially outwardly the by-pass spool valve 25 so that the projection 25A of the by-pass spool valve 25 is held in abutting engagement with the race of the rear needle bearing 7B and that the passage 32 is made open by the upper circumferential groove 27 and at the same time the fist by-pass passage 34 is made closed by the lower land 25D.

The front wall of the rear-ring plate 5 opposing the rotor 6, as shown in FIGS. 1 and 4, have formed therein a pair of upper semiarcuate groove 30A which is in communication at its one end with the back-pressure passages 11 and at it the other end with an oblique passage 31 which is in turn in communication with the bearing bore 22 through the groove 22A, and lower semiarcuate groove 30B which is in communication at its one end with the back-pressure passages 11 and at its the other end with the passage 32 open to the valve bore 21. As noted above, the by-pass spool valve 25 is normally urged radially inwardly by the compression spring 26 so that the passage 32 is made open to the valve bore 21 through the upper circumferential groove 27 of the by-pass spool valve 25. Accordingly, when the rotary-vane compressor 1 according to the present invention is in normal operation, the lubricating oil admitted to the bearing bore 22 through the first oil passage 12 is first restricted by an orifice ring 33 held against the rear needle bearing 7B by a compression spring 46 (FIG. 5) and then supplied to the back-pressure passages 11 through the groove 22A, passage 31 and upper semiarcuate groove 30A and through the groove 22A, oblique passage 29, upper circumferential groove 27 and lower semiarcuate grooves 30B, so that the rear ends of the vanes 10 are exposed to vane-back or high pressure existing in the back-pressure passages 11.

The first by-pass passage 34 arranged between the first intake port 14 of the two intake ports 14 and the high-pressure chamber 18 is blocked, when the electrically operated coil 23 is not energized, by the lower land 25D of the by-pass spool valve 25 because the spool valve 25 is urged by the compression spring 26 in the upward direction in FIG. 1. On the other hand, when the electrically operated coil 23 is energized, the spool valve 25 is caused to move in the downward direction in FIG. 1 against the compression spring 26 so that the first by-pass passage 34 is brought into fluid communication with the high-pressure chamber 18 through the lower circumferential groove 28 of the spool valve 25. At the same time, by reason of the downward movement of the spool valve 25, the passage 32 is blocked by the upper land 25B of the spool valve 25 so that the supply of the lubrication oil under high pressure to the lower semiarcuate groove 30B and accordingly to some of the back-pressure passages 11 is cut off.

Figure 3:
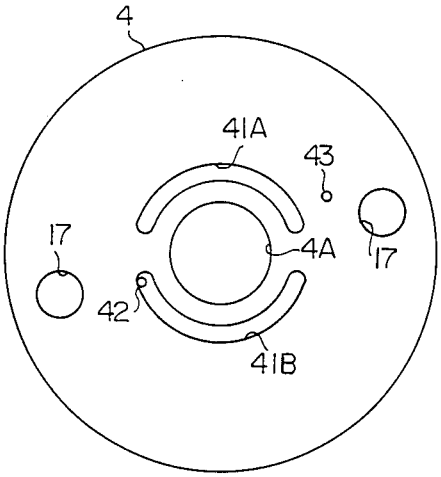
FIG. 3 is a rear end view of a front-ring plate shown in the FIG. 1, the front-ring plate being mounted on the front end of the cam ring shown in FIGS. 1 and 2.

The front-ring plate 4 secured to the rotor 6 is provided with an one-way flow check valve 35 for the purpose of blocking fluid communication between the first intake port 14 and the low-pressure chamber 16 only when the first by-pass passage 34 is made open by the spool valve 25. The one-way flow check valve 35 is received in a groove formed in the front-ring plate 4 and interposed between the low-pressure chamber 16 and the first inlet passage 17 corresponding to the first intake port 14. The one-way flow check valve 35 permits the refrigerant to enter the first inlet passage 17 from the low-pressure chamber 16 and prevents the reverse flow from the first inlet passage 17 to the low-pressure chamber 16. As clearly shown in FIG. 5, the front-ring plate 4 is further formed with a radially extending passage 36 and a radially extending valve bore 37 which are in fluid communication with each other. The passage 36 is open at one end thereof to the front bearing bore 4A and at the other end thereof to one end of the valve bore 37. The other end of the valve bore 37 is open to the first inlet passage 17. In the valve bore 37 is slidably received second valve means such, for example, as a second spool valve 38 which is formed with an upper projection 38A for blocking the passage 36, an upper land 38B, a lower land 38C, and a circumferential groove 38D between the upper and lower lands 38B and 38C. Second spring means such as a compression spring 39 is seated between the radially inward end wall of the valve bore 37 and the upper land 38B of the spool valve 38 for urging the spool valve 38 radially outwardly so that the lower land 38C of the second spool valve 38 is held in engagement with a stop member 40 received in a groove formed in the front-ring plate 4. The stop member 40 is formed with a circular bore 40A. When the lubricating oil high pressure is conducted to the first intake port 14 and the first inlet passage 17 through the first by-pass passage 34 and thus acts on the second spool valve 38 through the circular bore 40A of the stop member 40, the second spool valve 38 is caused to move in the upward direction in FIG. 5 so that the upper projection 38A of the spool valve 38 blocks the passage 36 open to the bearing bore 4A. As shown in FIGS. 3 and 5, in the front-ring plate 4 is formed upper and lower semiarcuate grooves 41A and 41B which are held in fluid communication with the upper and lower semiarcuate grooves 30A and 30B formed in the rear-ring plate 5 through the back-pressure passages 11, respectively. An obliquely extending second by-pass passage 42 is provided in front-ring plate 4 for establishing fluid communication between the back-pressure passages 11 and the low-pressure chamber 16 through the lower semiarcuate groove 41B. Accordingly, when high pressure is created in the first intake port 14, the second spool valve 38 is urged in the upward direction against the compression spring 39 so that the lower semiarcuate groove 41B is brought into fluid communication with the low-pressure chamber 16 through the circumferential groove 38D of the spool valve 38 and the second by-pass passage 42. As a result of the fluid communication, intake or low pressure existing in the low-pressure chamber 16 become substantially equal to pressure in back of of the vanes 10 through the back-pressure passages 11. In the upper portion of the front-ring plate 4 is provided a second oil passage 43 for the purpose of lubricating portions of the front-ring plate 4 and rotor 6 which are subjected to friction during rotation of the rotor 6. The second oil passage 43 is open at its one end to the bearing bore 4A and at its the other end to an oil space defined by the rear wall of the front-ring plate 4 and the front wall of the rotor 6.

Operation of the rotary-vane compressor arranged and constructed as described above will be hereinafter described in detail.

In normal operation of the compressor in which the discharge volume of the compressor is not controlled, that is to say, the first by-pass spool valve 25 assumes a position in which the passage 32 is made open and the first by-pass passage 34 is made closed, the refrigerant to be compressed is first admitted to the pump chamber 13 from the first and second intake ports 14 through the inlet port 15A, low-pressure chamber 16 and first and second inlet passages 17. The refrigerant admitted to the pump chamber 13 is then compressed to a predetermined pressure by the vanes 10 and discharged through the discharge ports 15 to the high-pressure chamber 18. In this case, the refrigerant volume discharged corresponds to full capacity of the rotary-vane compressor constructed in accordance with the present invention. Lubricating oil contained in the refrigerant is separated by the oil separator 20 and then reservoired in the bottom portion of the main housing 2A. This lubricating oil under high pressure is admitted to the rear bearing bore 22 of the rear-ring plate 5 through the first oil passage 12. The lubricating oil supplied to the rear bearing bore 22 is decreased in pressure after restricted by the orifice ring 33, and thereafter lubricates the rear needle bearing 7B. A part of the lubricating oil is further conducted to the upper semiarcuate groove 30A through the groove 22A and the passage 31, while the remaining part is conducted to the lower semiarcuate groove 30B through the groove 22A, the oblique passage 29, the upper circumferential groove 27 of the spool valve 25, and the passage 32. The lubricating oil supplied to the upper and lower semiarcuate grooves 30A and 30B is then conducted to the back-pressure passages 11, so that the bottom ends of the vanes 10 are exposed to the back pressure existing in the back-pressure passage 11. The lubricating oil further supplied to the upper and lower semiarcuate grooves 41A and 41B through the back-pressure passages 11 is conducted to the front bearing bore 4A of the front-ring plate 4 through a part of the second by-pass passage 42, the valve bore 37 and the passage 36, and then lubricates the front needle bearing 7A. Finally, the lubricating oil lubricates through the second oil passage 43 the portions of the front-ring plate 4 and rotor 6 which are subjected to friction and then returns to the pump chamber 13.

In the case the discharge volume of the compressor exceeds a required quantity by reason of the change of atmospheric temperature, humidity and the like, the first by-pass spool valve 25 is moved in the downward direction in FIGS. 1 and 5 by energizing the electrically operated coil 23 with the suitable actuator (not shown), that is, when an external signal is supplied. As a result of the downward movement of the spool valve 25, the first intake port of the two intake ports 14 is brought into fluid communication with the high-pressure chamber 18 through the lower circumferential groove 28 of the valve spool 25. Accordingly, the refrigerant under high pressure in the high-pressure chamber 18 enters the pump chamber 13 through the first intake port 14, so that high pressure is created in front of the vanes 10. Thus, the radially outmost ends of the vanes 10 are exposed to the high pressure. At the same time, the supply of the lubricating oil to the lower semiarcuate groove 30B from the bearing bore 22 is cut off so that a part of the lubricating oil is not conducted to a port of the back-pressure passages 11, for the reason that the passage 32 is blocked by the upper land 25B of the first spool valve 25 due to the abovementioned downward movement of the first spool valve 25.

Since the hydraulic pressure in the first intake port 14 of the two intake ports 14 is increased due to the refrigerant conducted from the high-pressure chamber 18 through the first by-pass passage 34, the low-pressure chamber 16 is closed by the one-way flow check valve 35 so that the refrigerant in the low-pressure chamber 16 cannot flow in the first intake port 14 through the first inlet passage 17. As high pressure is created in the first intake port 14 and the first inlet passage 17, the lower end of the second spool valve 38 is exposed to the high pressure through the circular bore 40A of the stop member 40. This high pressure causes the spool valve 37 to move in the upward direction against the compression spring 39 so that the projection 38A of the spool valve 38 blocks the passage 36 open to the bearing bore 4A. At the same time, the low-pressure chamber 16 is brought into fluid communication with the lower semiarcuate groove 41B through the second by-pass passage 42, the circumferential groove 38D of the spool valve 38. Accordingly, the refrigerant in the low-pressure chamber 16 is conducted to some of the back-pressure passages 11 through the lower semiarcuate groove 41B so that the vane-back pressure in back of some of the vanes 10 received in the slots 10A held in communication with the some of back-pressure passages 11 to which the refrigerant in the low-pressure chamber 16 is conducted, become substantially equal to the low or intake pressure existing in the low-pressure chamber 16. Thus, the radially innermost ends of the some of the vanes 10 are exposed to the low pressure. As noted above, the discharge pressure is to be supplied in front of the vanes 10 through the first by-pass passage 34 and the intake pressure is to be supplied in back of the vanes 10 through the second by-pass passage 42. For this reason, the vanes 10 are retracted radially inwardly in the slots 10A when the rotor 6 rotates across the first intake port 14 which is in fluid communication with the high-pressure chamber 18 through the first by-pass passage 34. Thus, the refrigerant in the pump chamber 13 is not compressed across the first intake port 14. Since low and high pressures exist between chambers defined by adjacent vanes 10, an extremely low pressure cannot be created in one side of the pump chamber 13. Accordingly, the refrigerant under high pressure and temperature existing in the other side of the pump chamber 13 cannot leak in the one side of the pump chamber 13 therefrom, and only one side of the pump chamber 13 cannot be overheated. In addition, since the rotor 6 rotates across the first intake chamber 14 with the vanes 10 retracted in the slots 10A, power lost is minimized and wear on the cam ring 3 and vanes 10 is kept at a minimum. Furthermore, since only the refrigerant required is used, the discharge refrigerant is prevented from being abnormally overheated and the life of the compressor itself is increased.

While it has been illustrated and described that the vanes 10 of the rotor 6 is retracted in the slots 10A by providing the second spool valve 38 in the front-ring plate 4 so that the radially inward ends of the vanes 10 is exposed to low pressure in the back-pressure passages 11 when refrigerant under pressure is admitted to the radially outward ends of the vanes 10 through the first by-pass passage 34, it is noted that if the back-pressure passages are constructed such that the vane-back pressure is predeterminedly reduced to low pressure, the vanes may be retracted in the slots by only the high pressure admitted to the first intake port 14.

While a certain representative embodiment has been shown for the purpose of illustrating this invention, it will be apparent to those skilled in this art that various changes and modifications may be made in the embodiment selected for disclosing my invention without departing from the spirit and scope of the invention.

What is claimed is:

1. A rotary-vane compressor comprising:

a main housing formed with a high-pressure chamber;

a front-housing plate secured to said main housing and formed with a low-pressure chamber; and compression means arranged within said main housing;

said compression means comprising a pump housing comprising a cam ring formed with a substantially eliptical cam surface and first and second ring plates mounted on said cam ring to close said cam ring, a rotor rotatably supported within said cam ring and formed with a plurality of substantially radially extending slots and a plurality of back-pressure passages each held in fluid communication with an radially inward end of the corresponding slot, and a plurality of vanes each received slidably in the corresponding slot, lubricating oil in said high-pressure chamber being conducted to said back-pressure passages;

said cam surface of said cam ring and an outer peripheral surface of said rotor forming a pump chamber;

said cam ring being formed with first and second intake ports which respectively communicate at their one ends with said low-pressure chamber and at their the other ends with said pump chamber and a pair of discharge ports which respectively communicate at their one ends with said pump chamber and at their the other ends said high-pressure chamber, wherein said pump housing is formed with a first by-pass passage which is open at its one end to said first intake port and at its the other end with said high-pressure chamber, and provided with first by-pass valve means so that said first by-pass passage is opened when an external signal is supplied, and said first ring plate is provided with an one-way flow check valve to block fluid communication between said first intake port and said low-pressure chamber only when said first by-pass passage is opened.

2. A rotary-vane compressor as set forth in claim 1, in which said first ring plate is formed with a second by-pass passage which communicates at its one end with said low-pressure chamber and at its the other end with some of said back-pressure passages, and provided with second by-pass valve means so that said second by-pass passage is opened only when said first by-pass passage is opened.

3. A rotary-vane compressor as set forth in claim 1, in which said pump housing is further formed with a further passage which communicates at its one end with some of said plurality of back-pressure passages and at its the other end with said high-pressure chamber, said further passage being closed when said first by-pass passage is opened.

4. A rotary-vane compressor as set forth in claim 1, in which said first by-pass valve means comprises a first spool valve formed with a land and a circumferential groove, the first spool valve being normally urged radially inwardly by first spring means so that said first by-pass passage is closed by said land, and when said external signal is suppied, the first spool valve being urged radially outwardly so that said first by-pass passage is opened by said circumferential groove.

5. A rotary-vane compressor as set forth in claim 3, in which said first by-pass valve means comprises a first spool valve formed with an upper land, a lower land, an upper circumferential groove and a lower circumferential groove, the first spool valve being normally urged radially inwardly by first spring means so that said passage communicated with said some back-pressure passages is opened by said upper circumferential groove and said first by-pass passage is closed by said lower land, and when said external signal is supplied, the first spool valve being urged radially outwardly so that said passage communicated with said some back-pressure passages is closed by said upper land and said first by-pass passage is opened by said lower circumferential groove.

6. A rotary-vane compressor as set forth in claim 2, in which said second valve means comprises a second spool valve formed with a land and a circumferential groove, the second spool valve being normally urged radially outwardly so that said second by-pass passage is closed by said land, and when said first by-pass passage is opened, the second spool valve being urged radially inwardly so that said second by-pass passage is opened by said circumferential groove.

* * * * *